US006622785B2

(12) United States Patent
Haegele et al.

(10) Patent No.: US 6,622,785 B2
(45) Date of Patent: Sep. 23, 2003

(54) FOLDED MULTI-PASSAGEWAY FLAT TUBE

(75) Inventors: Juergen Haegele, Stuttgart (DE); Volker Kurz, Stuttgart (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 10/132,383

(22) Filed: Apr. 26, 2002

(65) Prior Publication Data

US 2002/0174979 A1 Nov. 28, 2002

(30) Foreign Application Priority Data

Apr. 28, 2001 (DE) ..... 101 21 001

(51) Int. Cl.[7] ..... F28F 1/00

(52) U.S. Cl. ..... 165/177; 165/183; 29/890.053; 138/38

(58) Field of Search ..... 165/183, 174, 165/177; 138/38, 115, 170, 171; 29/890.053, 890.049, 890.046

(56) References Cited

U.S. PATENT DOCUMENTS

| | | | | |
|---|---|---|---|---|
| 2,151,540 A | * | 3/1939 | Varga | 138/117 |
| 5,307,870 A | | 5/1994 | Kamiya et al. | |
| 5,323,851 A | | 6/1994 | Abraham | |
| 5,386,629 A | | 2/1995 | Ouchi et al. | |
| 5,511,613 A | | 4/1996 | Mohn et al. | |
| 5,730,215 A | | 3/1998 | Hirano et al. | |
| 5,784,776 A | * | 7/1998 | Saito et al. | 29/890.046 |
| 5,979,051 A | | 11/1999 | Kato et al. | |
| 6,209,202 B1 | * | 4/2001 | Rhodes et al. | 29/890.053 |
| 6,247,529 B1 | * | 6/2001 | Shimizu et al. | 165/183 |

FOREIGN PATENT DOCUMENTS

| | | |
|---|---|---|
| DE | 299 06 337 U | 8/1999 |
| DE | 100 14 099 | 1/2001 |
| EP | 0 219 974 | 4/1987 |
| EP | 0 302 232 | 4/1991 |
| EP | 0 457 470 | 11/1991 |
| EP | 0 617 250 | 9/1994 |
| EP | 0 881 449 | 12/1998 |
| EP | 1 074 807 | 2/2001 |

* cited by examiner

*Primary Examiner*—Terrell McKinnon
(74) *Attorney, Agent, or Firm*—Foley & Lardner

(57) ABSTRACT

A folded multi-passageway flat tube is disclosed, which is made from a flat sheet metal strip and has folded webs and a longitudinal seam. Through-openings for improving the heat transfer and for generating transverse flow are provided in the folded webs. The through-openings are advantageously made by punching in the flat sheet metal strip, that is to say before folding, and are made congruent after folding. These folded multi-passageway flat tubes are preferably used for refrigerant condensers in motor vehicle air-conditioning systems.

24 Claims, 11 Drawing Sheets

FOLDED MULTI-PASSAGEWAY FLAT TUBE

CROSS REFERENCE TO RELATED PATENT APPLICATIONS

The right of priority under 35 U.S.C. §119(a) is claimed based on German Patent Application No. 101 21 001.9, filed Apr. 28, 2001, the entire disclosure of which is hereby incorporated by reference.

BACKGROUND OF THE INVENTION

The present invention relates to a one-piece multi-passageway flat tube with folded webs, and to a method of manufacturing such a multi-passageway flat tube. The invention also relates a heat exchanger embodying at least one such multi-passageway flat tube.

Flat tubes of this general type are disclosed in commonly-assigned European Patent EP 0 302 232 B1. Such a tube is made from a metal strip, and the webs for forming the individual passageways are produced by folding the metal strip. These webs are consequently double-walled and, at their bending site, form a web ridge which is brazed to the inside of the flat tube. The longitudinal seam of such a flat tube can likewise be produced by brazing. The metal strip is preferably clad with brazing material on both sides, so that brazing is possible on both the inside and the outside of the flat tubes.

Another construction for a folded multi-passageway tube is disclosed in U.S. Pat. No. 5,386,629 or European Patent EP 0 457 470, wherein the design of the longitudinal seam differs in that, in this case, it is arranged on the narrow side of the flat tube and produced by butt-welding or brazing.

Further embodiments of folded multi-passageway flat tubes, which are made from a flat sheet-metal strip and brazed together, are disclosed in commonly-owned German Utility Model 299 06 337 and also in EP-A 1 074 807.

The flat tubes mentioned above are used as both coolant tubes for coolant heat exchangers and refrigerant tubes for condensers in vehicle air-conditioning systems. In particular in the case of refrigerant condensers, high heat transfer capacity is desired, for which reason the hydraulic diameter of the individual passageways is dimensioned very small, that is to say in the range of one to two millimeters. These tubes nevertheless still have potential for increasing the heat transfer capacity.

SUMMARY OF THE INVENTION

One principal object of the present invention is to provide a one-piece folded multi-passageway tube improved with regard to its heat transfer capability. A further object of the invention is to provide improved methods for producing the improved multi-passageway tubes. A still further object of the invention is to provide improved heat exchangers embodying the tubes according to the invention, as well as improved automotive heating/air-conditioning systems embodying such heat exchangers.

In accordance with one aspect of the present invention, there has been provided a multi-passageway flat tube, comprising: a sheet metal strip folded into the form of a generally flat tube and having a longitudinal seam, wherein the folded metal sheet includes at least one folded web directed toward the inside of the flat tube and having two walls forming a common contact surface and a web ridge, the web ridge being brazed to at least one inner wall of the fiat tube to form multiple axially extending passageways within the tube, and wherein the web includes at least one through-opening to permit communication between the passageways and is brazed in at least part of the area of the contact surface.

In accordance with another aspect of the invention, there is provided a method of manufacturing a multi-passageway flat tube as defined above, which comprises: providing an endless, flat sheet metal strip; punching the through-openings according to a predetermined pattern; folding the sheet metal strip to form webs, so that one adjacent through-opening meets a corresponding adjacent through-opening; forming the sheet metal strip containing the webs into a closed multi-passageway flat tube cross section; and brazing the web ridges to the opposing inner wall of the flat tube or to respective opposing web ridges and brazing the longitudinal seam.

According to yet a further aspect of the invention, there has been provided another method of manufacturing a multi-passageway flat tube, which comprises: providing an endless, flat sheet metal strip; folding the sheet metal strip to form the webs; fashioning notches in the web ridges by stamping or rolling; forming the sheet metal strip containing the webs into a closed multi-passageway flat tube cross section; and brazing the web ridges to the inner wall of the tube or to corresponding opposing web ridges and brazing the longitudinal seam.

Still another method is provided of manufacturing a multi-passageway flat tube, which comprises: providing an endless, flat sheet metal strip; producing the at least one slit according to a predetermined pattern; folding the sheet metal strip to form the webs, so that one adjacent slit meets another adjacent slit; de-forming at least one slit edge; forming the sheet metal strip containing the at least one edge into a closed multi-passageway flat tube cross section; and brazing the web ridges to the opposing inner wall of the tube or to corresponding opposing web ridges and brazing the longitudinal seam.

According to a further aspect of the invention, there has also been provided a method of manufacturing a multi-passageway flat tube, which comprises: providing an endless, flat sheet metal strip; folding the sheet metal strip to form the webs; forming the web ridges into an undulating shape; forming the sheet metal strip containing the undulating shape into a closed multi-passageway flat tube cross section; and brazing the web ridges to the opposing inner wall of the tube or to respective opposing web ridges and brazing the longitudinal seam.

Another aspect of the invention involves a heat exchanger suitable for use in a motor vehicle, comprising at least one header and at least one multi-passageway flat tube opening into the header, wherein the at least one multi-passageway flat tube comprises a multi-passageway flat tube as defined above.

Finally, the invention provides as another aspect a motor vehicle air-conditioning system, comprising at least one refrigerant-carrying heat exchanger, wherein the heat exchanger comprises a heat exchanger as defined above.

Further objects, features and advantages of the present invention will become apparent from the detailed description of preferred embodiments that follows, when considered together with the accompanying figures of drawing.

DETAILED DESCRIPTION OF PREFERRED EMBODIMENTS

Figure 1:
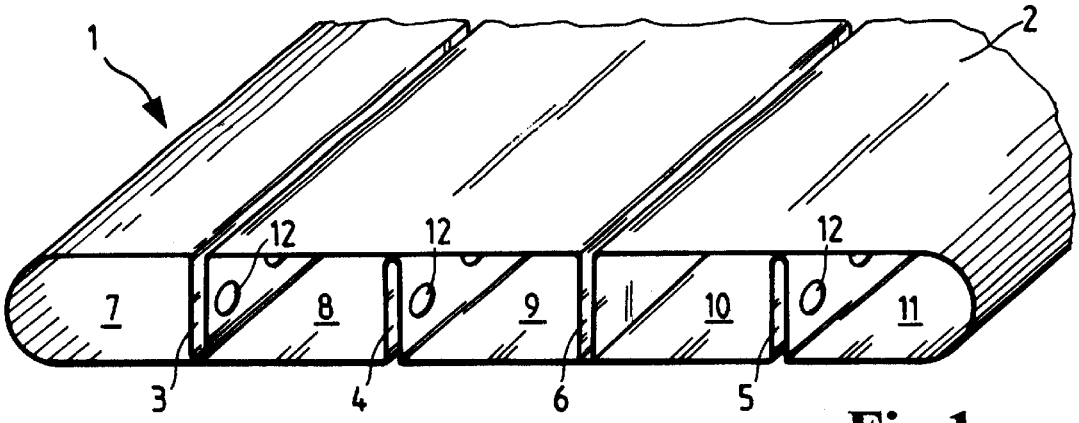
FIG. 1 is a perspective end view of a folded multi-passageway tube with through-openings in the webs.

According to the invention the webs have through-openings, that is to say passage openings, which make possible transverse connection and thus transverse flow of the refrigerant or of the heat transfer medium from one flow passageway into another. The heat transfer is thus improved.

Such through-openings are known per se for non-folded multi-passageway tubes, for example from DE-A 100 14 099. However, this multi-passageway tube is made from at least two parts, that is to say the tube is assembled from at least two tube elements, one tube element having a base plate with non-folded webs (what are known as reinforcing walls), in which the through-openings are made, and the other tube element constituting a plane cover plate which is subsequently connected to the first tube element to form a closed tube cross section. In this two-piece construction of a multi-passageway flat tube, it is relatively simple to make the through-openings, especially as the connecting holes are made from the upper edge of the reinforcing walls. In the event that the connecting holes lie within the reinforcing walls, the through-openings have to be made in the webs in advance, before the latter are connected to the tube wall. The manufacturing method for such a coolant tube is therefore too involved.

Finally, from U.S. Pat. No. 5,323,851, extruded multi-passageway tubes with through-openings in the web walls are also known. However, the manufacture of such tubes is relatively difficult and is thus associated with high costs.

The advantage of the invention therefore consists in that, on the one hand, the heat transfer on the inside of such multi-passageway tubes can be increased and, on the other hand, in that this is possible in folded flat tubes made from a sheet metal strip. By virtue of the fact that the starting material is clad with brazing material on both sides, it is ensured that the webs designed as a fold, that is to say with double walls, are brazed to one another in the area of their contact surfaces and directly outside the through-openings, so that the impermeability of the tube is guaranteed.

A further advantage results from the fact that the web ridges are brazed to an inner wall of the flat tube over their entire length, that is to say in the longitudinal direction of the tube. As a result, such a tube can withstand a relatively great bursting pressure, which is particularly important in refrigerant condensers.

According to a further inventive aspect, the web ridges of in each case two folded webs are opposite and brazed to one another. In an advantageous embodiment, this makes it possible to make two through-openings in each case, which are opposite one another and, after brazing, form a passage opening.

Advantageously, the webs form a right angle with a tube wall, as the web height can in this way be adapted simply to the distance between two tube walls. It should nevertheless be expressly pointed out that, within the scope of the invention, any angle between a web and a tube wall is conceivable.

According to a further embodiment of the invention, the through-openings are designed as notches which start from the web ridge. While it is true that this interrupts the brazed seam between the web ridge and the inner wall of the flat tube or between two web ridges, this type of through-opening nevertheless affords advantages in manufacture, in particular with regard to the impermeability of the tube.

In a preferred design of the multi-passageway flat tube according to the invention, the through-openings are slit-shaped. This makes possible optional opening out of the through-opening by bending open an edge of the web adjacent to the slit.

According to a further inventive aspect, a slit-shaped through-opening is at least partly formed by a portion of the web ridge not being brazed to a tube wall or to an opposite ridge of another web.

According to a further inventive aspect, a multi-passageway flat tube has at least one web which is of undulating design at least in the area of the web ridge. As a result, the flow of the medium flowing through the flat tube is influenced to the effect that the heat transfer is improved.

In a further modification of the invention, in each case two webs are brazed to one another, at least one of the webs being of undulating design at least in the area of the web ridge. In this connection, passage openings can be present between two brazed-together webs, through which openings the medium flowing through the flat tube can pass. Within the scope of the invention, however, the two web ridges can also be brazed to one another over their full length, so that no passage is opened up between the corresponding flow passageways.

According to a further embodiment of the invention, a manufacturing method is provided, by way of which the through-openings or, if appropriate, the notches are made in the sheet metal strip by punching before the webs are folded. This method according to the invention allows both continuous manufacture of the folded multi-passageway tube by what is known as rotation stamping and also stamping of the through-openings in a cyclical procedure. The through-openings are arranged in the sheet metal strip according to a predetermined pattern in such a manner that, after the folding operation, they lie directly on one another, that is to say are aligned with one another. During subsequent brazing together of the inner contact surfaces, these through-openings are sealed to the outside.

According to a further configuration of the invention, an advantageous method of producing the notches provides that these notches are fashioned in the web ridges by rolling after folding. The depth of the notches corresponds approximately to the thickness of the sheet metal strip, and the outer skin of the web ridge can consequently remain closed, so that an improvement in the impermeability of the tube is achieved.

In an especially preferred method, slits are cut or punched into an endless, flat sheet metal strip, which slits, after folding of the webs, lie on one another in pairs and, if appropriate, are widened to form large-area openings by bending at least one web edge adjacent in each case to a slit. The sheet metal is then shaped to form a closed multi-passageway flat tube, after which brazing of the web ridges to the inner wall of the flat tube or, if appropriate, to in each case another web ridge and finally of the longitudinal seam takes place.

In a further method according to the invention, webs are folded into an endless, flat sheet metal strip, the web ridges of which webs are bent to form an undulating shape. The sheet metal is subsequently shaped to form a closed multi-passageway flat tube, after which brazing of the web ridges to the inner wall of the flat tube or, if appropriate, to in each case another web ridge and finally of the longitudinal seam takes place.

FIG. 1 shows a diagrammatic perspective illustration of a folded multi-passageway tube. The multi-passageway tube 1 is made from a folded sheet metal strip 2 and has three webs 3, 4 and 5 which are designed as folds, that is to say made by folding the sheet metal strip 2. The fourth web 6 is formed by the longitudinal edge regions of the sheet metal strip 2. These webs 3, 4, 5 and 6 form five ducts or passageways 7, 8, 9, 10 and 11, through which a heat transfer medium, for example, a refrigerant, flows. Arranged in the webs 3, 4, 5 are circular through-openings 12, which allow transverse flow of the heat transfer medium from one duct into the neighboring duct.

Figure 1A:
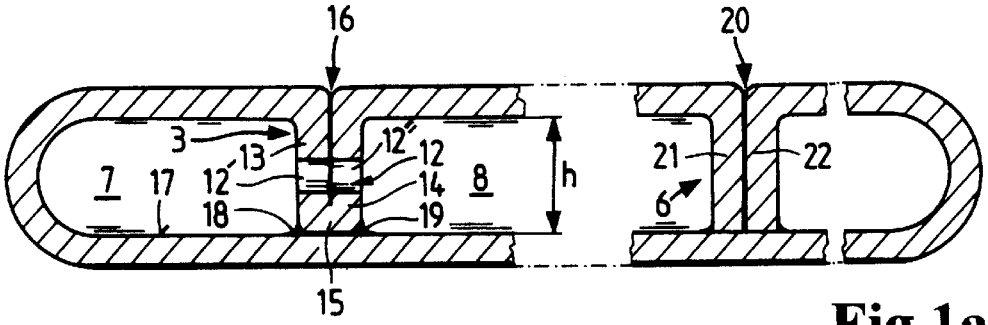
FIGS. 1*a* to 1*d* are cross-sectional views showing variants of a multi-passageway tube according to FIG. 1.

FIG. 1*a* shows a cross section through the multi-passageway tube according to FIG. 1. The same reference numbers are used for the same parts. The web 3 is formed by two adjacent legs 13 and 14 which are interconnected via a web ridge 15 and have a common contact surface 16. The web 3 and the passageways 7 and 8 have a height h. At roughly half height, that is to say centrally in relation to the web height, the through-opening 12 is arranged, that is to say it is in each case formed by a through-opening 12' in the leg 13 and a through-opening 12" in the leg 14, the two through-openings 12' and 12" being aligned with one another. Around the through-opening 12 and in the area of the common contact surface 16, the two legs 13 and 14 are brazed to one another, so that the through-opening 12 and thus the passageways 7 and 8 are sealed to the outside. The web ridge is brazed to the inner wall 17, which is indicated by the brazing meniscuses 18 and 19. The other webs 4 and 5 are of similar design. The web 6 forms the longitudinal seam 20 of the multi-passageway tube 1 and is formed by the adjacent, brazed-together edge regions 21 and 22 of the sheet metal strip 2. Although not illustrated in the drawing, through-openings can also be arranged in the web 6 in a similar manner.

Figure 1B:
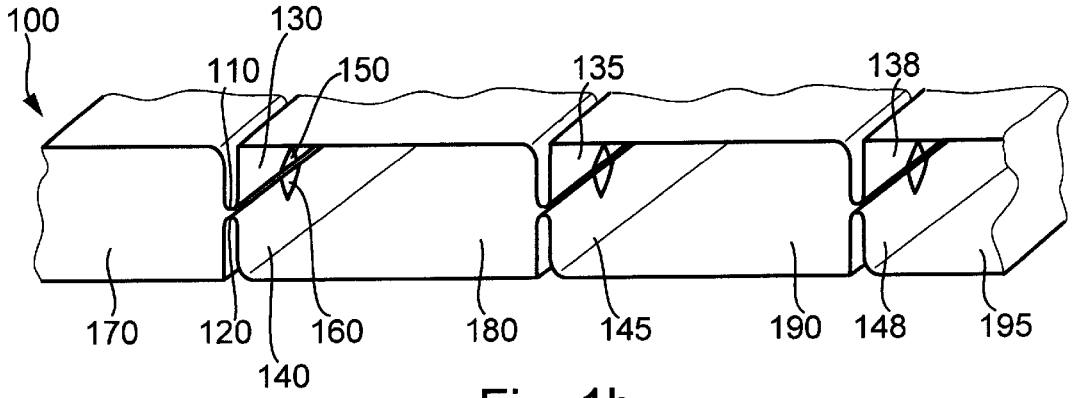

FIG. 1*b* shows a further illustrative embodiment of a multi-passageway flat tube 100 according to the invention. In this case, the web ridges 110 and 120 of the webs 130 and 140, respectively, are opposite one another and brazed to one another. The through-openings 150 in web 130 and 160 in web 140, which are notch-shaped in this example, are likewise opposite one another and together form a passage opening between the passageways 170 and 180 for the medium flowing through the multi-passageway tube. The webs 135 and 145 between the passageways 180 and 190 and the webs 138 and 148 between the passageways 190 and 195 are of similar construction.

Figure 1C:
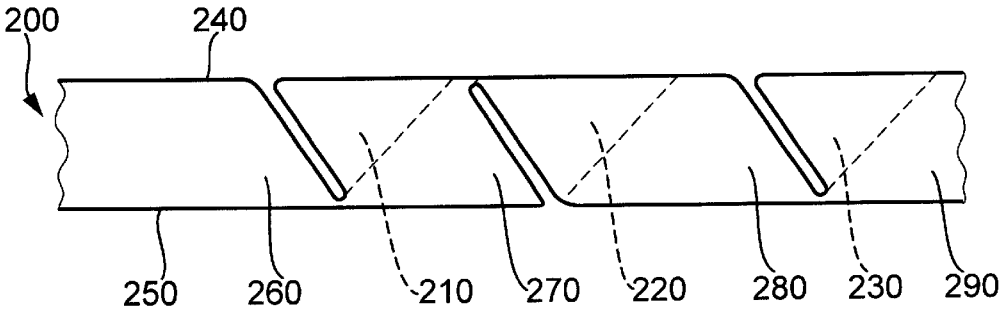
Figure 1D:
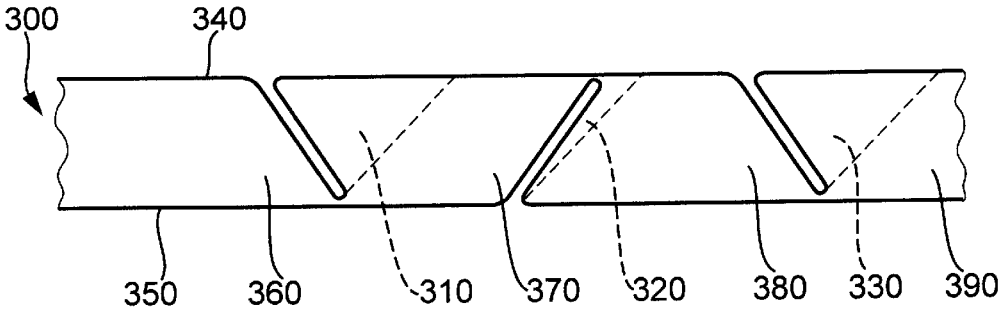

FIGS. 1*c* and 1*d* show two examples of a multi-passageway tube with webs which do not form a right angle with one of the tube walls. In the example illustrated in FIG. 1*c*, the webs 210, 220 and 230 are parallel to one another but are inclined in relation to the tube walls 240 and 250. In FIG. 1*d*, the webs 310, 320 and 330 are inclined alternately in one of the two possible directions in relation to the tube walls 340 and 350. The inclined arrangement of the webs in FIG. 1*c* and FIG. 1*d* allows the cross-sectional shape of the ducts 260, 270, 280 and 290 and, respectively, 360, 370, 380 and 390 to be adapted to improved heat transfer with regard to the flow conditions. For the sake of clarity, the through-openings are not illustrated.

Figure 2:
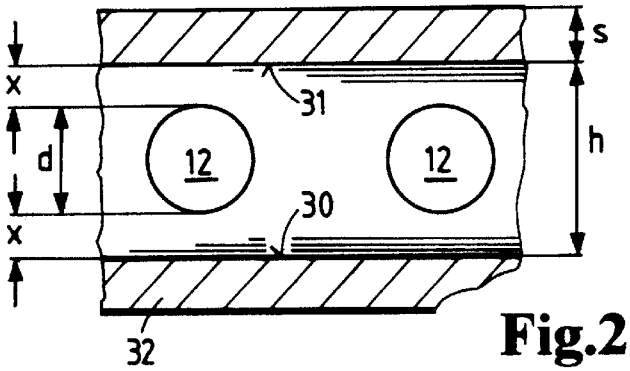
FIG. 2 is a partial longitudinal sectional view showing the circular through-openings.

FIG. 2 shows a partial section in the longitudinal direction of the multi-passageway tube 1 with the through-openings 12, which are of circular design and are in each case at a distance x from the inside surfaces 30, 31 of the tube wall 32. In this illustrative embodiment, the web height h=1.0 mm, and the diameter of the circular through-openings d=0.8 mm, so that a minimum distance of x=0.1 mm is obtained. The thickness of the tube wall 32 s=0.4 mm.

Figure 3:
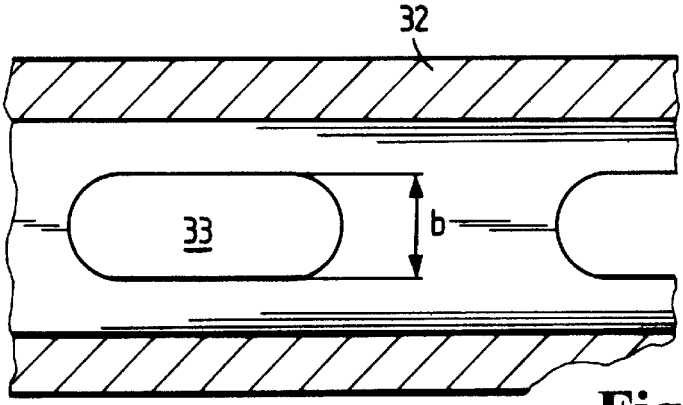
FIG. 3 is a partial longitudinal sectional view showing through-openings of oval cross-sectional shape.

FIG. 3 shows a similar partial section. In this case, the cross-sectional shape of the through-openings 33 is oval, and each oval has the same height b=0.8 mm as in the illustrative embodiment according to FIG. 2, but the longitudinal extent is a multiple of the height.

Figure 4:
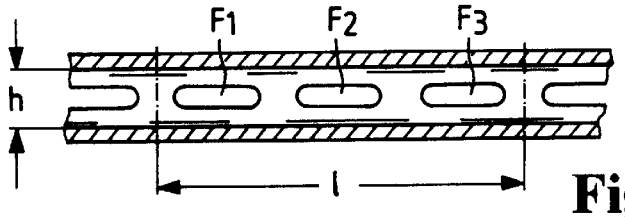
FIG. 4 is a partial longitudinal sectional view showing the opening ratio.

FIG. 4 shows the distribution of the through-openings in the longitudinal direction of the multi-passageway tube: three through-openings of cross-sectional area $F_1$, $F_2$ and $F_3$ are arranged over a length I, and the web or passageway height is h. If the sum of the cross-sectional areas of the through-openings is expressed as a ratio in relation to the web area without through-openings, that is to say related to a web area l ×h, the following opening ratio V can be defined:

$$V = \frac{F_1 + F_2 + F_3}{1 \times h} \times 100, \text{ where } 5\% \leq V \leq 10\%.$$

This opening ratio V is thus preferably between 5 to 10%, in order to achieve an improvement of the heat transfer and a genuine transverse flow of the heat transfer medium from one flow duct into another.

Figure 5:
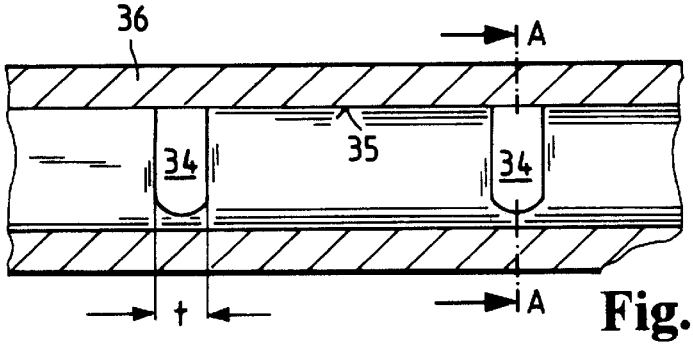
FIG. 5 is a longitudinal sectional view showing a further cross-sectional shape (open slots) for the through-openings.
Figure 5A:
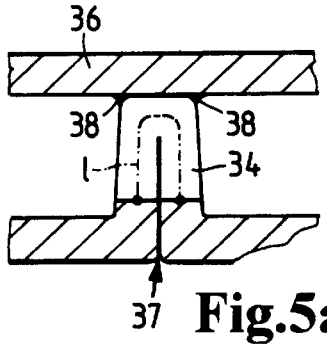
FIG. 5*a* is a cross section taken along section plane A—A in FIG. 5.

FIG. 5 shows a partial section similar to FIGS. 2 and 3, with a modified cross-sectional shape: in this case, the through-openings 34 are of elongate design, that is to say the longitudinal extent runs in the vertical direction, the uppermost contour of the through-opening 34 adjoining the inside 35 of the tube wall 36. FIG. 5*a* alongside shows a section along the section plane A—A in FIG. 5. This design of the through-openings 34 has the advantage that the brazed seam 38 is interrupted for only relatively short distances in the longitudinal direction, namely, in the area of the width t of the through-openings 34. This increases the strength of the tube in relation to the internal pressure.

Figure 5B:
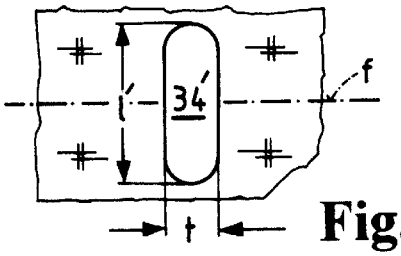
FIG. 5*b* is a view showing a cutout for the "slot" punching geometry.

FIG. 5*b* shows a cutout from the as yet unfolded sheet metal strip with the punching geometry 34' for the through-openings 34. This punching geometry shows a slot 34' with width t and (developed) length l'. The line along which the sheet metal strip is folded after punching is indicated by the dot-dash line f. In FIG. 5*a*, a U-shaped broken line l is drawn in as a midline; this line corresponds to the developed length l' in FIG. 5*b*.

Figure 6:
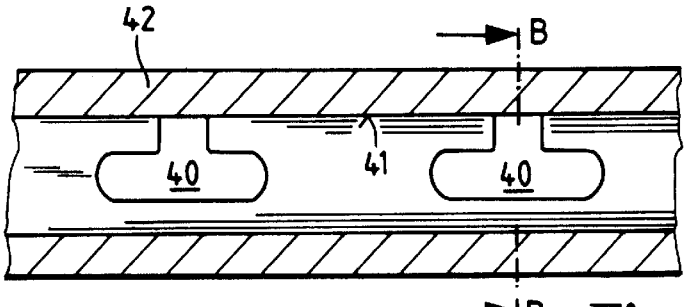
FIG. 6 is a longitudinal sectional view showing a further cross-sectional shape (T-shaped) for the through-openings.
Figure 6A:
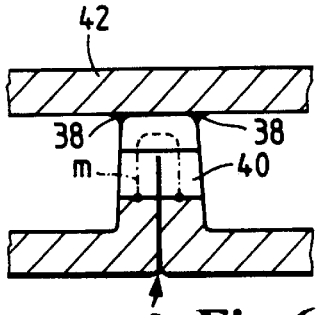
FIG. 6*a* is a cross section taken along section plane B—B in FIG. 6.

FIG. 6 shows a further cross-sectional shape: the through-openings 40 are of approximately T-shaped design, this "T" being upside down. The horizontal bar of the T is at the bottom, and the upright extends upward as far as the lower edge 41 of the tube wall 42. A section along the plane B—B is illustrated in FIG. 6*a*. In both sectional illustrations in FIGS. 5*a* and 6*a*, it is to be pointed out that the contact surfaces 37 and 43, respectively, of the fold are brazed together impermeably in order to guarantee the impermeability of the tube.

Figure 6B:
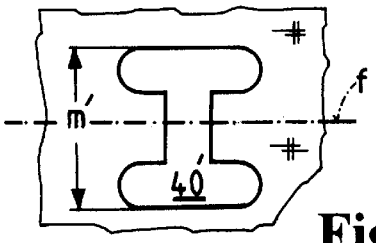
FIG. 6*b* shows a cutout for the "T-shaped" punching geometry.

FIG. 6*b* again shows a cutout from the as yet unfolded sheet metal strip with the punching geometry 40' for the through-openings 40. While the through-openings 40 are of T-shaped design, the punching geometry 40' has the shape of a double T, the folding line f being indicated by a dot-dash line. The height of the double T is indicated by m' and corresponds to the U-shaped line m in FIG. 6*a*. Both through-opening shapes 34 and 40 are therefore produced by punching and subsequent folding about the line f.

Figure 7:
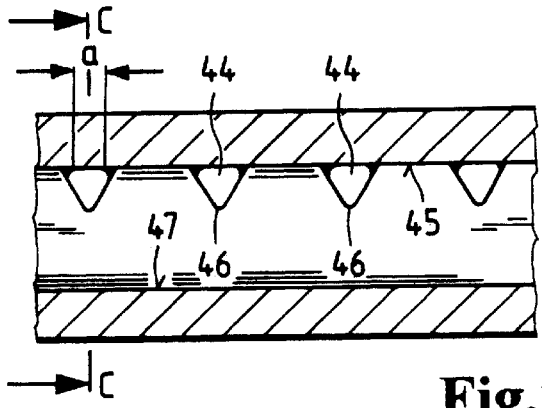
FIG. 7 is a longitudinal sectional view showing a further design for the through-openings as notches of triangular cross section.
Figure 7A:
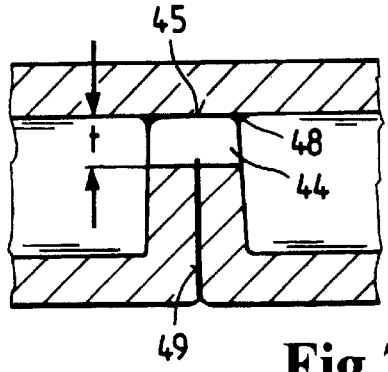
FIG. 7*a* is a cross sectional view through the multi-passageway tube according to FIG. 7 taken along the section plane C—C.

FIGS. 7 and 7*a* show a further embodiment of through-openings, which are designed as notches 44 of triangular cross-section. These notches start from the upper edge 45 of the web ridge and extend with their tip 46 toward the opposite side 47. The web ridge is, similarly to the previous illustrative embodiments, brazed by its upper edge 45 to the tube wall and in the area of the contact surface 49. The notches 44 each have a width a and a depth t.

Figure 8:
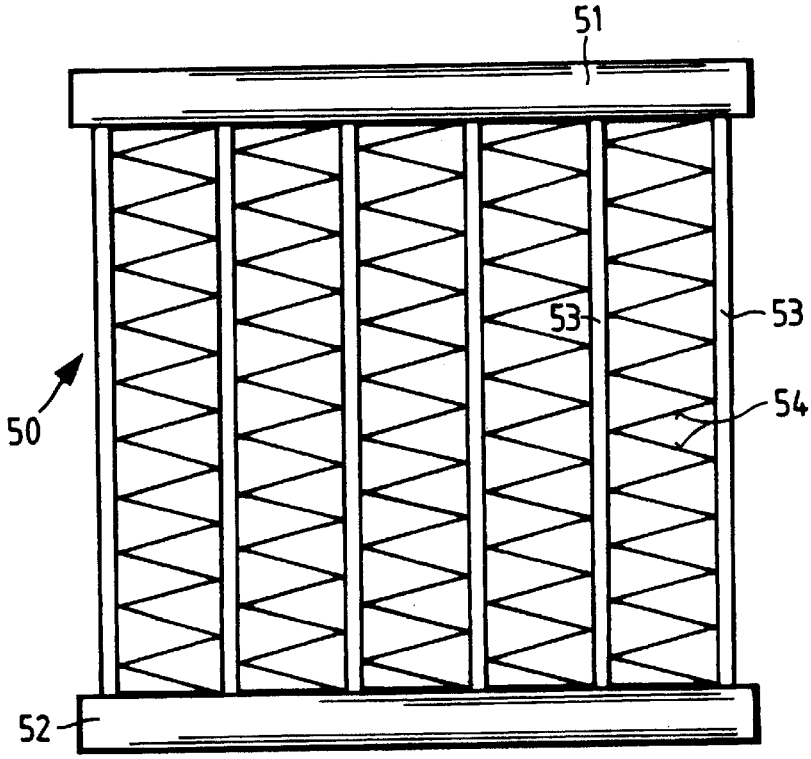
FIG. 8 is a schematic plan view showing a heat exchanger with multi-passageway tubes according to the invention.
Figure 9A:
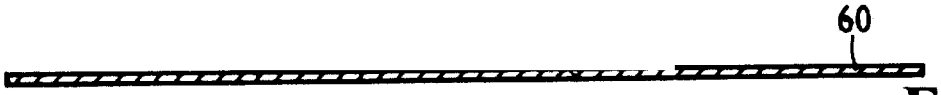
FIGS. 9*a* to 9*h* illustrate the method steps for manufacturing a multi-passageway tube with punched through-openings according to the invention.
Figure 9B:
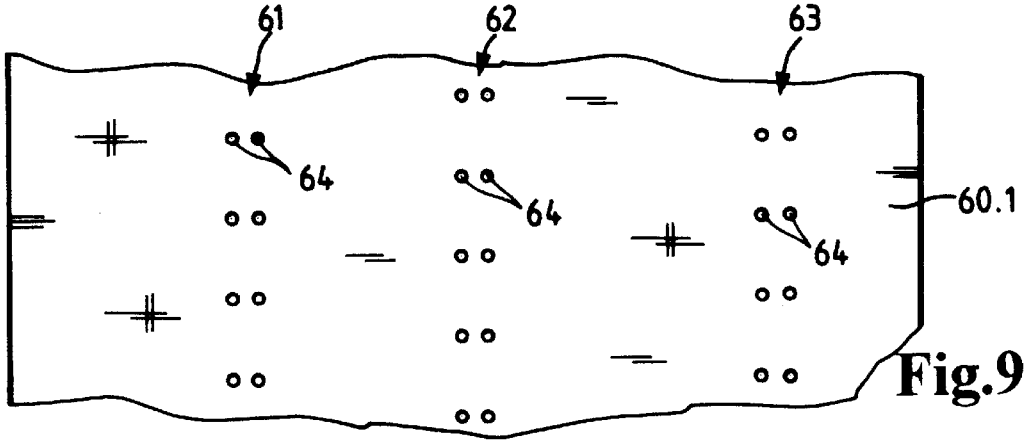
Figure 9C:
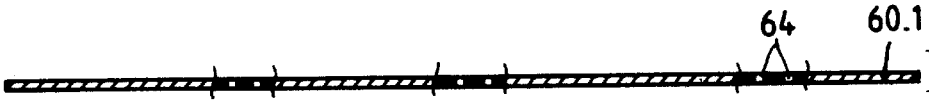
Figure 9D:
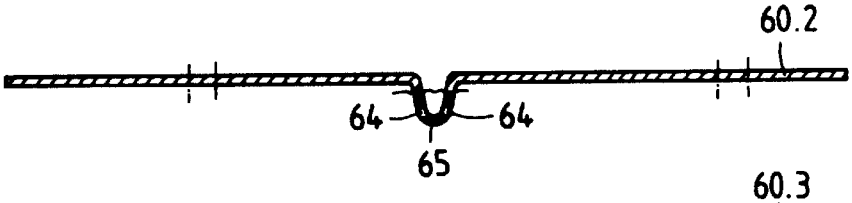
Figure 9E:
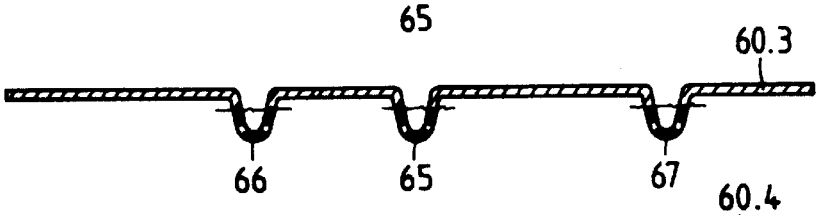
Figure 9F:
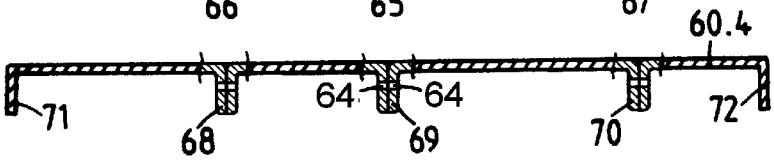
Figure 9G:
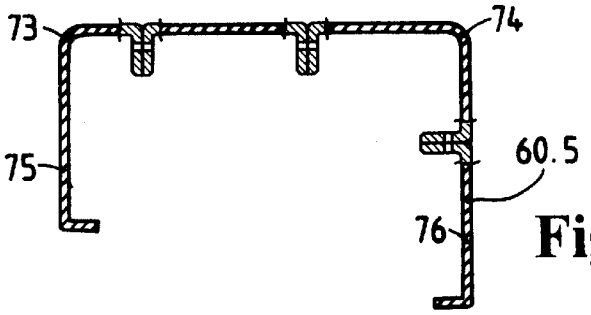
Figure 9H:
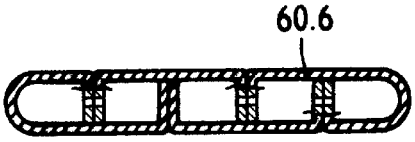

FIG. 8 shows a heat exchanger 50 which, in a known manner (for example from EP-A 0 219 974), has two manifolds or headers 51 and 52, between which a network consisting of flat tubes 53 and corrugated fins 54 is located. These flat tubes 53 are designed as multi-passageway tubes of the type described above and are flow-connected to the manifolds 51 and 52. They are brazed in a manner known per se in holes (not shown) in the manifolds 51 and 52. The corrugated fins 54 are brazed onto the outside of the flat tubes 53, which is possible owing to the multi-passageway tubes described above being clad with brazing material on both sides. In this respect, the entire heat exchanger 50, which consists only of parts made of an aluminum alloy, can be brazed in one operation.

FIGS. 9*a* to 9*h* show a diagrammatic illustration of the method steps a) to h) for manufacturing the multi-passageway tubes according to the invention, e.g., according to the illustrative embodiments in FIGS. 1 to 6. In a first method step a), a tube-forming machine (not illustrated) is supplied with an endless flat strip 60, which is perforated (according to a predetermined pattern) in a second method step b): corresponding to the number and position of folds (cf. FIGS. 1 and 1*a*), three rows 61, 62 and 63 of circular through-openings 64 are punched into the flat strip 60. This punching can take place either continuously by what is known as rotation punching or cyclically, individual portions of the flat strip being perforated in each case. The cyclical punching of the through-openings can take place in a separate tool station and before the flat strip is supplied to the tube-forming machine. This has the advantage that the punching rate is independent of the rate at which the flat strip is supplied to the tube-forming machine. In this respect, the perforated flat strip can be supplied to the tube-forming machine directly from the coil. The result of the "punching" method step is illustrated by the perforated strip 60.1 in b) and c). In the next method step d), a first crimp 65 is fashioned in the strip 60.1 in the area of the hole row 62 and, in the following method step e), two further crimps 66 and 67 are fashioned in the strip 60.2 in the area of hole rows 61 and 63, so that the strip shape 60.3 is produced. In a further forming step f), the crimps 65, 66, and 67 are converted into folds 68, 69 and 70, and the edges of the strip 60.3 are erected to form webs 71 and 72. During the production of the folds 68, 69 and 70, it is ensured that through-opening 64 meets the corresponding through-opening 64, and a passage opening is thus formed. In the following method step g), the folded strip 60.4 is bent with in each case a radius 73 and 74, so that the tube depth is already defined. In the last method step h), further bending of the projecting legs 75 and 76 into a parallel position then takes place, so that the finished multi-passageway tube 60.6 is obtained. This is brazed in a further method step (not illustrated), that is to say preferably together with the corrugated fins and the other parts of the heat exchanger as a whole.

Figure 10A:
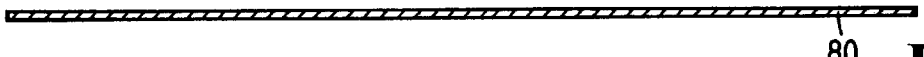
FIGS. 10*a* to 10*h* illustrate the method steps for manufacturing a multi-passageway tube with stamped through-openings.
Figure 10B:
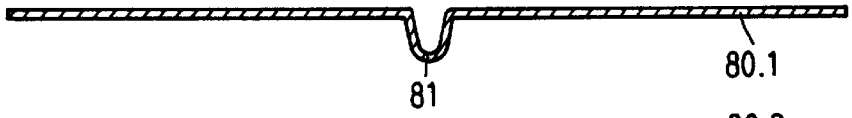
Figure 10C:
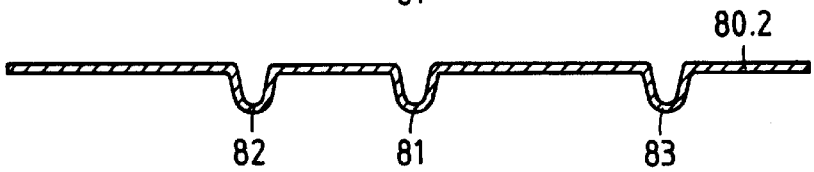
Figure 10D:
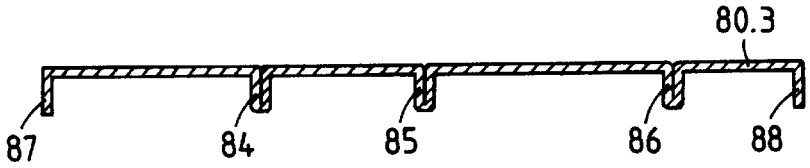
Figure 10E:
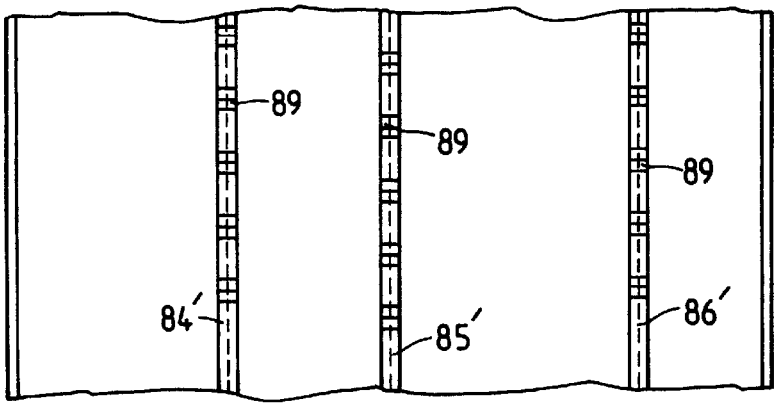
Figure 10F:
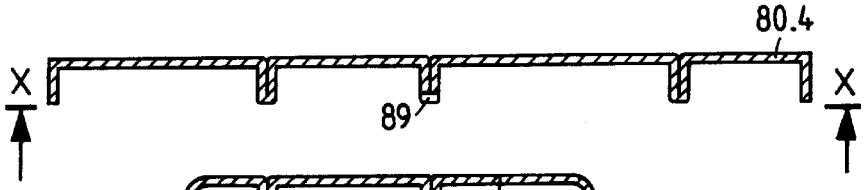
Figure 10G:
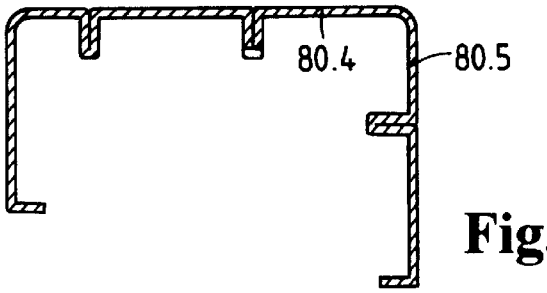
Figure 10H:
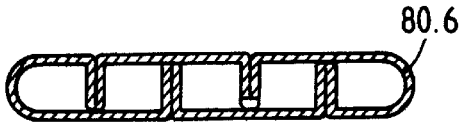

FIGS. 10*a* to 10*h* illustrate another manufacturing method with method steps a) to g). In method step a), an endless flat strip 80 is supplied; in method step b), a first crimp 81 is fashioned; in method step c), two further crimps 82 and 83 are fashioned, and, in method step d), folds 84, 85, 86 and erected edge regions 87 and 88 are formed. The reference numbers 80, 80.1, 80.2 and 80.3 designate the endless strip in each case after performance of the individual method steps. In method step e), transversely running crimps or notches 89 are stamped into the web ridges 84', 85' and 86' of the individual folds 84, 85 and 86, that is to say by non-cutting forming. This can be effected, for example, by a rolling movement running transversely to the strip direction, or by a stamping roller, the circumferential velocity of which runs in the same direction as the advance of the strip. The illustration of method step e) is shown in FIG. 10*e* and 10*f*, that is to say as a view in the direction X—X and as a cross section through the strip 80.4 (FIG. 10*f*). The further method steps f) and g) proceed similarly to method steps g) and h) of the illustrative embodiment according to FIG. 9. Therefore, initially the shape 80.5 is formed, and finally the finished (still unbrazed) multi-passageway tube 80.6. The brazing (not illustrated) is carried out in one operation with the entire heat exchanger.

Figure 11:
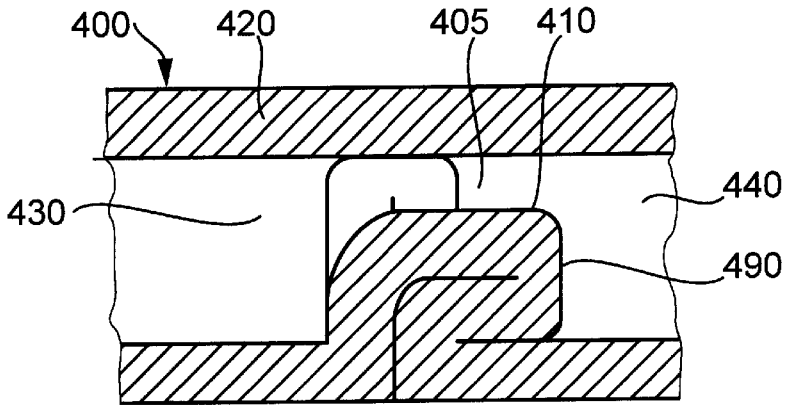
FIG. 11 is a partial longitudinal cross-sectional view showing a further design of a through-opening as a bent-open slit.

FIG. 11 shows the cross section of a further example of the formation of a through-opening 405 in a web 410 of a multi-passageway flat tube 400 according to the invention. In this case, the web 410 is bent over laterally along part of its length, so that an opening 405 between the passageways 430 and 440 remains free between the bent-over part and the opposite tube wall 420.

Figure 11A:
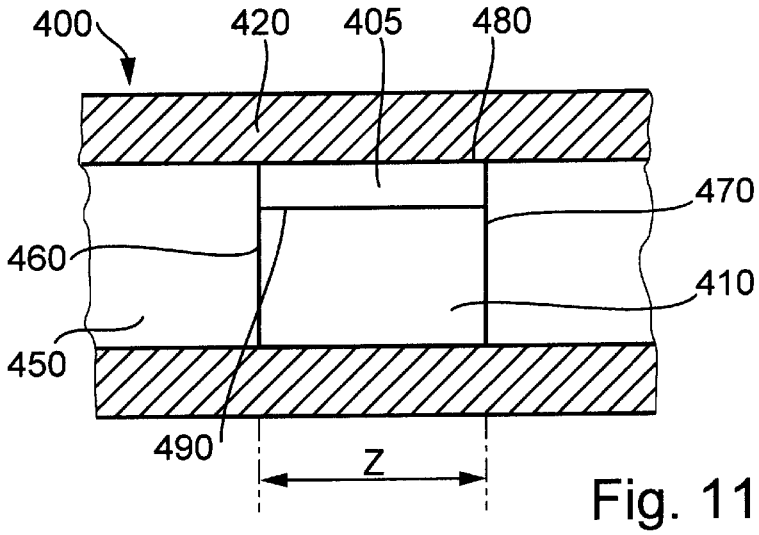
FIG. 11*a* is a cross-sectional view showing a design of a through-opening as a bent-open slit according to FIG. 11.

In FIG. 11*a*, a longitudinal section of the through-opening 405 from FIG. 11 can be seen. It is clear here that, before part of the web 450 is bent over, a slit must be made in the web, which in this case consists of three individual slits 460, 470 and 480, the slit 480 being produced by the web ridge 490 not being brazed to the opposite tube wall 420 over the length z.

Figure 11B:
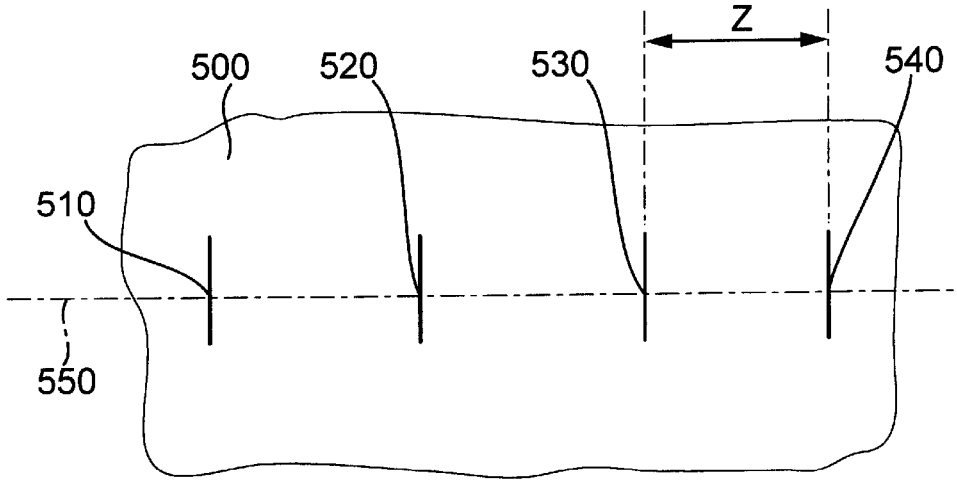
FIG. 11*b* shows a slit arrangement in a sheet metal strip for preparation of through-openings according to FIG. 11 and 11*a;*

The arrangement of slits in a sheet metal strip 500 before the webs are folded, which is necessary for a through-opening according to FIGS. 11 and 11*a*, is shown in FIG. 11*b*. Slits 510 and 520, and 530 and 540, in each case in pairs at a distance z from one another, are cut into the sheet metal strip 500 symmetrically in relation to a folding edge 550, the future web ridge. When the web is folded, in each case a U-shaped slit together with in each case a part of the web ridge is then produced. The part of the web between the slits 510 and 520, and 530 and 540, can finally be bent over, as a result of which a through-opening as in FIGS. 11 and 11*a* is obtained.

Figure 12:
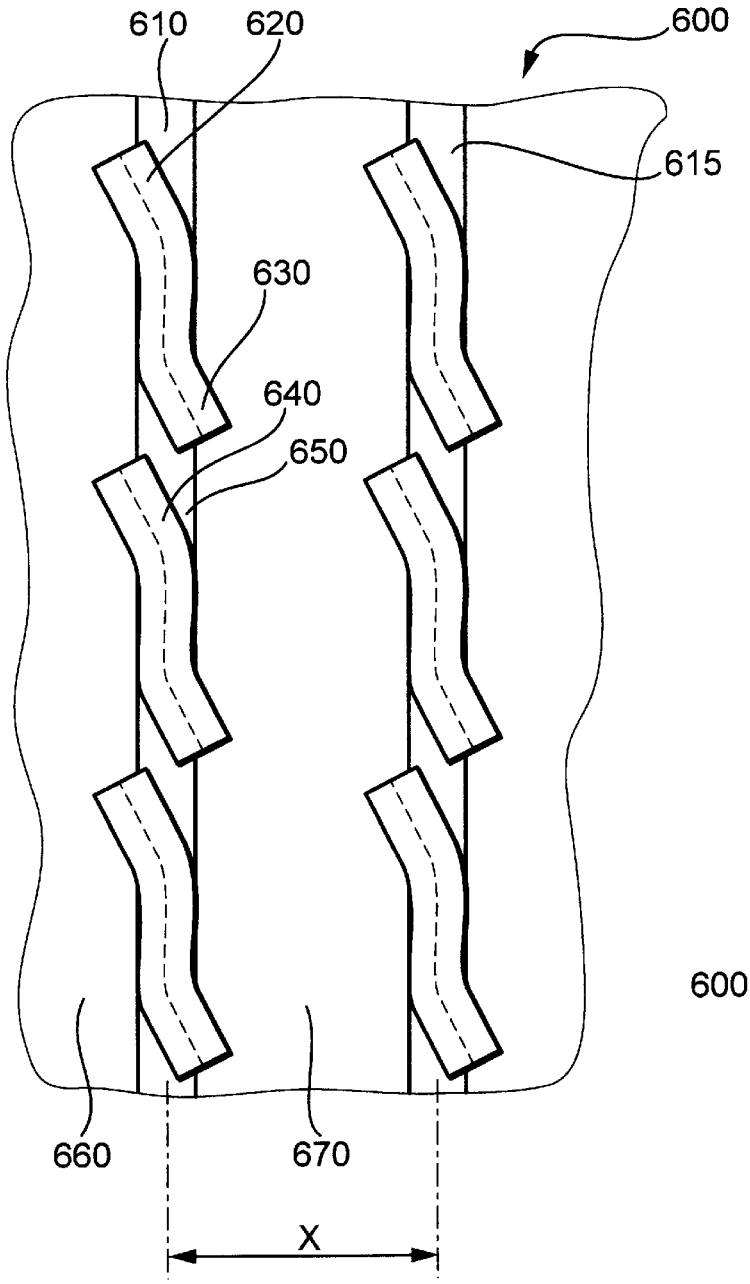
FIG. 12 is a top view showing an arrangement of webs with through-openings in the form of bent-open slits.

FIG. 12 shows a further possibility for forming through-openings in the form of bent-open slits in a multi-passageway flat tube 600 according to the invention. To this end, before the webs are folded, the sheet metal strip is provided with double-T-shaped slits which, after folding, have a T-shaped appearance and in each case define two freestanding regions 630 and 640 of the web 610, which are in turn bent out of the plane of the web 610. As a result, the slit is widened to form a through-opening 650 between the passageways 660 and 670.

Figure 12A:
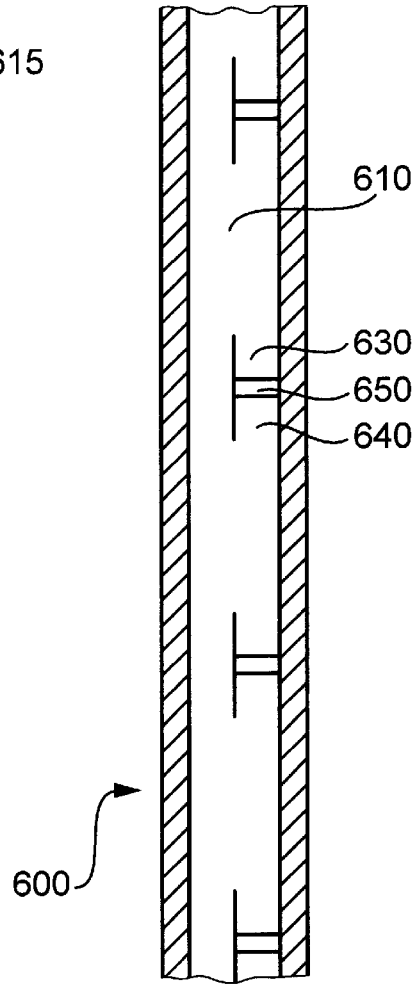
FIG. 12*a* is a longitudinal section showing a web with through-openings in the form of bent-open slits according to FIG. 12.

In FIG. 12*a*, the web 610 can be seen in a longitudinal section of the multi-passageway flat tube 600. The opening 650 between the bent-open regions 630 and 640 of the web is particularly clear here.

Figure 13:
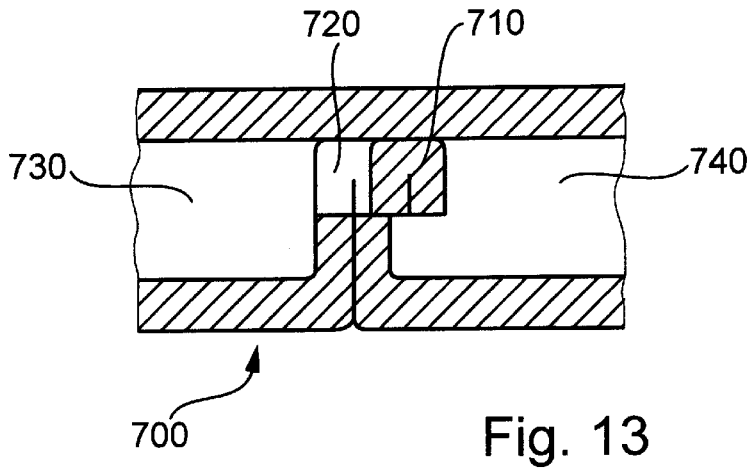
FIG. 13 is a cross sectional view showing a web with a through-opening in the form of a bent-open slit according to FIG. 12 and FIG. 12*a;*

FIG. 13 shows a cross section of the multi-passageway flat tube 700 according to FIGS. 12 and 12*a*. A bent-open region 710 of the web 720 between the passageways 730 and 740 can again be seen here, which region extends over part of the height of the web 720 in this example.

Figure 13A:
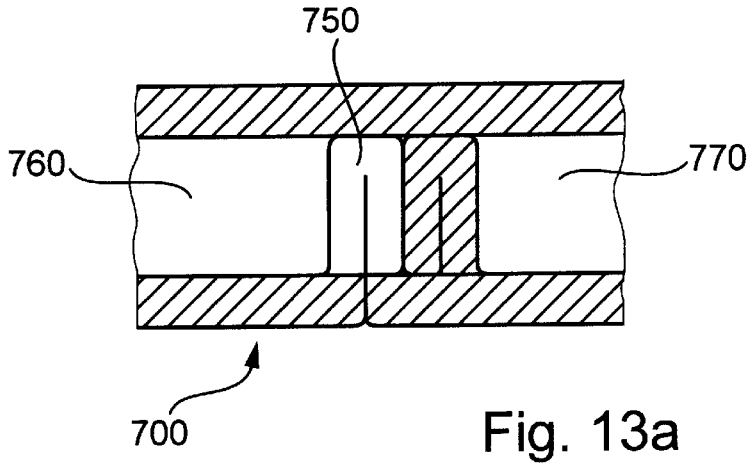
FIG. 13*a* is a cross sectional view showing a further design of a web with a through-opening in the form of a bent-open slit.

As illustrated in FIG. 13*a*, the web 750 is bent open over its entire height in a further embodiment of the invention, so that a larger opening between the adjacent passageways 760 and 770 is obtained.

Figure 13B:
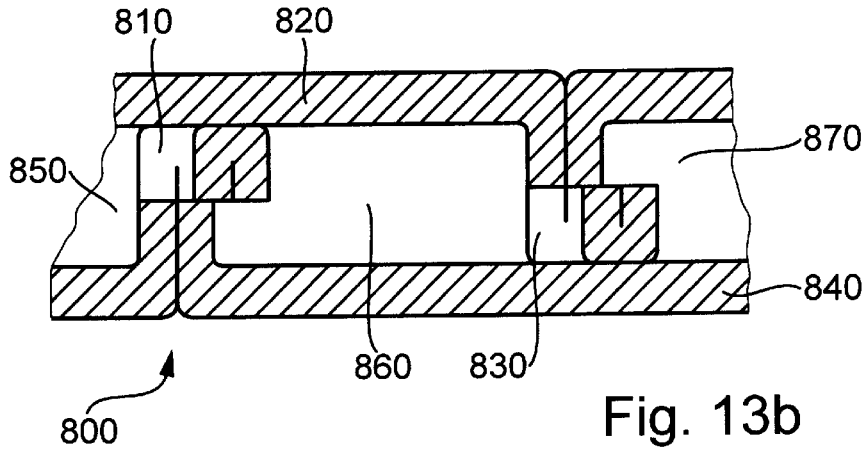
FIG. 13*b* is a cross sectional view showing a further arrangement of webs with through-openings in the form of bent-open slits.

FIG. 13*b* indicates a sequence of bent-open slits which, in contrast to the previous forms, alternates. In this design example of a multi-passageway flat tube 800 according to the invention, one web 810 is bent open on the side of one tube wall 820, but a neighboring web 830 is bent open on the side of a tube wall 840 that is opposite the tube wall 820. This influences the flow of a medium through the passageways 850, 860 and 870 to the effect that the heat transfer from the medium to another flowing medium is further enhanced.

Figure 14:
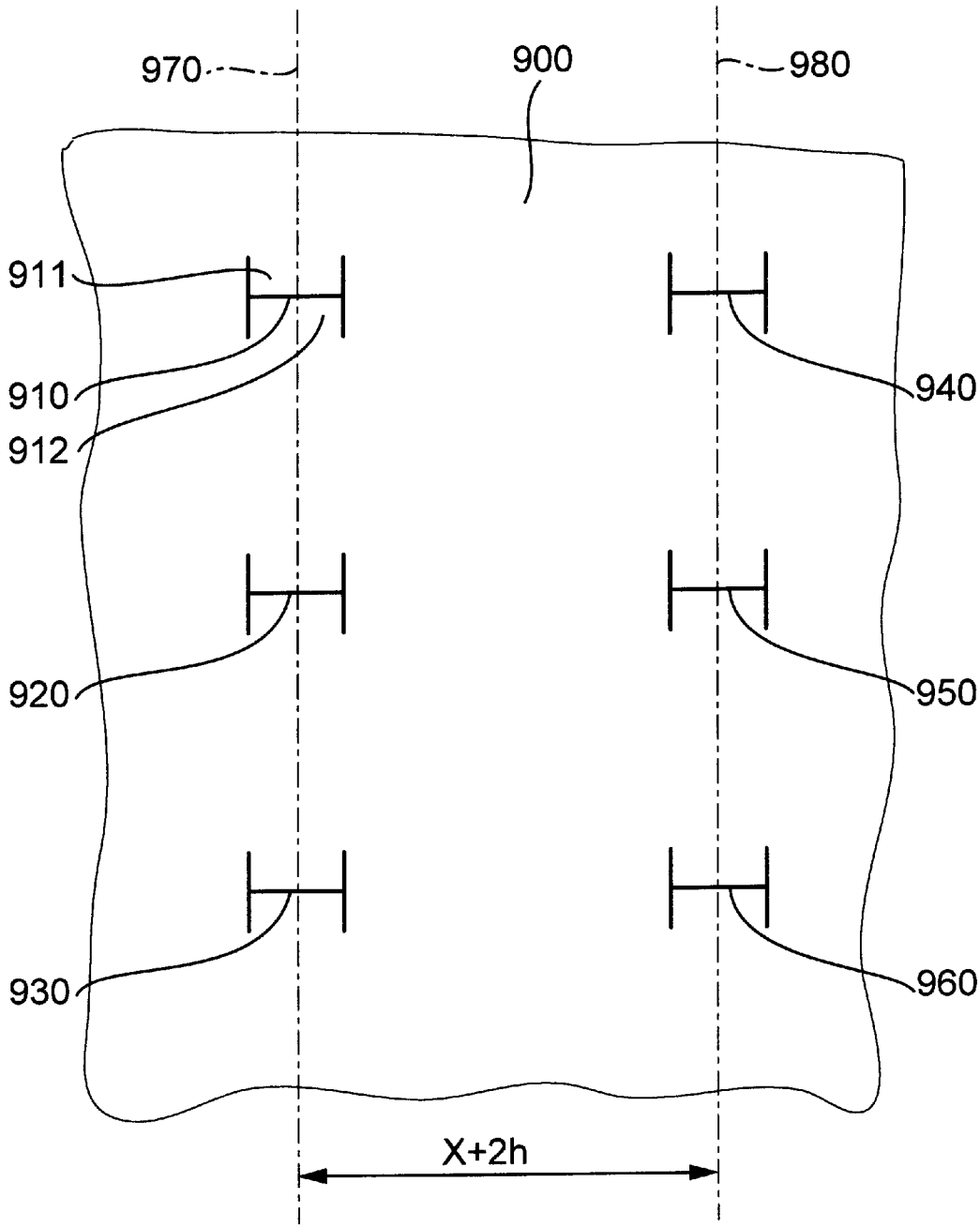
FIG. 14 shows a slit arrangement in a sheet metal strip for preparation of through-openings according to FIG. 12 to 13*b;*

FIG. 14 shows an arrangement of double-T-shaped slits 910, 920, 930, 940, 950 and 960 in a sheet metal strip 900, from which a multi-passageway tube according to the invention with through-openings as in FIGS. 12 to 13*b* will be formed. The slits 910, 920, 930, 940, 950 and 960 are formed axially symmetrically in relation to the folding edges 970 and 980, the future web ridges, so that, after folding, in each case two T-shaped slits come to lie on one another. The freestanding web regions 911 and 912 thus produced are then bent open, after which a multi-passageway flat tube according to the invention, for example as illustrated in FIG. 12, is obtained. In order to guarantee a distance x between two webs 610 and 615 in FIG. 12, the length x+2 h must be selected for the distance between two folding edges 970 and 980 on the sheet metal strip 900 in FIG. 14, h being the height of a web.

Figure 15:
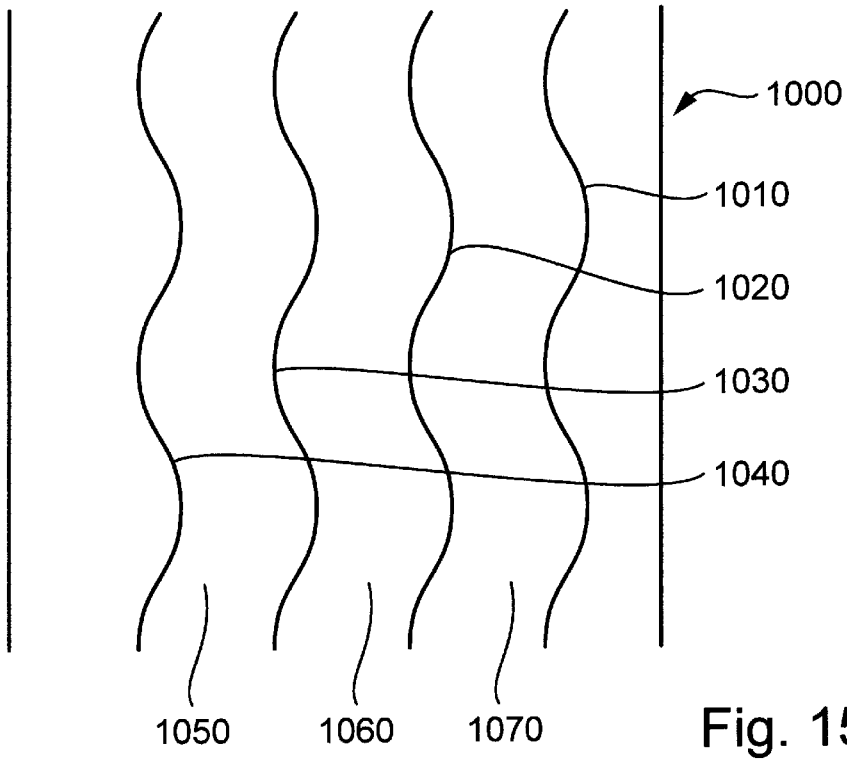
FIG. 15 is a top view showing an arrangement of webs with web ridges of undulating design.

FIG. 15 illustrates a further design example of a multi-passageway flat tube 1000 according to the invention. The web ridges 1010, 1020, 1030 and 1040 of the webs (not shown in greater detail here) are of undulating design, so that the flow of a medium through one of the passageways 1050, 1060 or 1070 adapts to this shape, as a result of which the heat transfer to a medium outside the multi-passageway tube 1000 is improved.

Figure 15A:
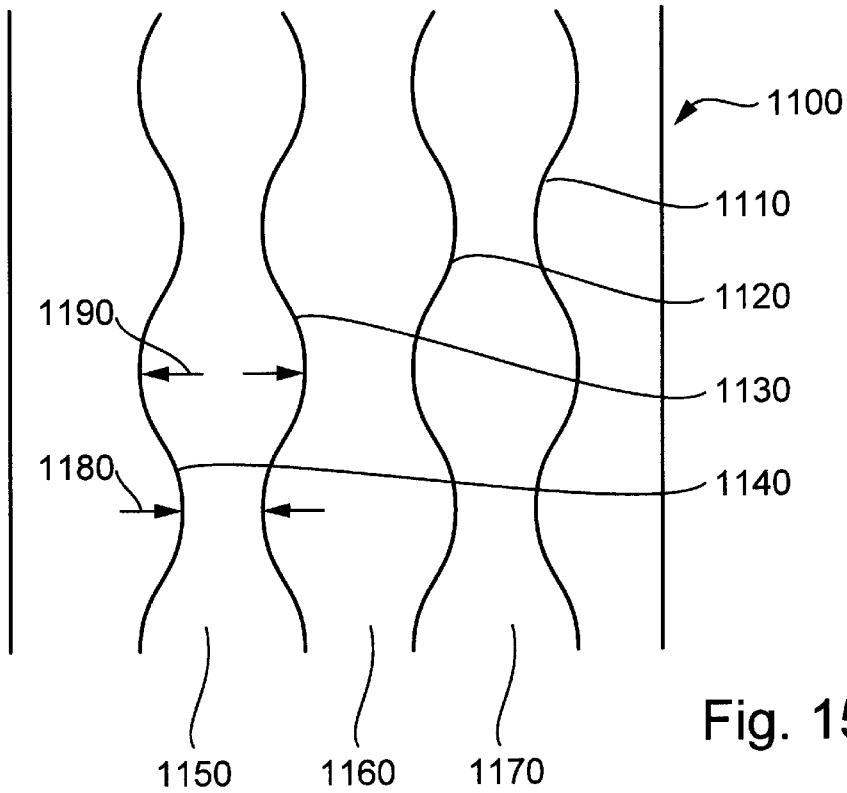
FIG. 15*a* is a top view showing a further arrangement of webs with web ridges of undulating design.

A further variant of a multi-passageway flat tube according to the invention is shown in FIG. 15*a*. Here, the undulating shapes of the web ridges 1110, 1120, 1130 and 1140 are displaced in relation to one another in the longitudinal direction of the webs in such a manner that the flow passageways 1150, 1160 and 1170 have tapering portions 1180 and widening portions 1190. As a result, the heat transfer is once again increased in relation to an arrangement as in FIG. 15.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A multi-passageway flat tube, comprising:

a sheet metal strip folded into the form of a generally flat tube and having a longitudinal seam, wherein the folded metal sheet includes at least one folded web directed toward the inside of the flat tube and having two walls forming a common contact surface and a web ridge, the web ridge being brazed to at least one inner wall of the flat tube to form multiple axially extending passageways within the tube, and wherein the web includes at least one through-opening to permit communication between the passageways and is brazed in at least part of the area of the contact surface.

2. A multi-passageway flat tube as claimed in claim 1, having at least two of said folded webs, wherein the web ridges of the two webs are brazed to one another and wherein at least one web has at least one through-opening.

3. A multi-passageway flat tube as claimed in claim 2, wherein each of the at least two webs has at least one through-opening and wherein at least two through-openings are opposite one another.

4. A multi-passageway flat tube as claimed in claim 1, wherein at least one web is arranged perpendicularly to a tube wall.

5. A multi-passageway flat tube as claimed in claim 1, wherein a plurality of through-openings are arranged at regular intervals in the axial direction of the flat tube.

6. A multi-passageway flat tube as claimed in claim 1, wherein the cross-sectional area of the through-openings of a web is approximately 5 to 10% of the area of the web without through-openings.

7. A multi-passageway flat tube as claimed in claim 1, wherein at least some of the through-openings are punched out.

8. A multi-passageway flat tube as claimed in claim 1, wherein the through-openings comprise notches which start from the web ridges.

9. A multi-passageway flat tube as claimed in claim 8, wherein the notches have an approximately triangular cross section.

10. A multi-passageway flat tube as claimed in claim 1, wherein the through-openings are arranged centrally in relation to the web height.

11. A multi-passageway flat tube as claimed in claim 1, wherein the cross-sectional shape of the through-openings is circular, oval or T-shaped.

12. A multi-passageway flat tube as claimed in claim 1, wherein the outer contour of the through-openings has a minimum distance x from the inner wall of the flat tube.

13. A multi-passageway flat tube as claimed in claim 1, wherein at least one through-opening comprises a slit shape.

14. A multi-passageway flat tube as claimed in claim 13, wherein the slit is at least partly produced by an unbrazed portion of the web ridge.

15. A multi-passageway flat tube as claimed in claim 13, wherein the at least one through-opening is expanded by forming at least one web edge adjacent to the slit.

16. A multi-passageway flat tube as claimed in claim 15, wherein in each case two web edges adjacent to a slit are formed in the same direction seen from the web.

17. A multi-passageway flat tube as claimed in claim 15, wherein in each case two web edges adjacent to a slit are formed in opposite directions seen from the web.

18. A heat exchanger suitable for use in a motor vehicle, comprising at least one header and at least one multi-passageway flat tube opening into the header, wherein the at least one multi-passageway flat tube comprises a multi-passageway flat tube according to claim 1.

19. A motor vehicle air-conditioning system, comprising at least one refrigerant-carrying heat exchanger, wherein the heat exchanger comprises a heat exchanger according to claim 23.

20. A multi-passageway flat tube made from a sheet metal strip and having a longitudinal seam and at least one folded web which has two walls with a common contact surface and a web ridge which is brazed to at least one inner wall of the flat tube or to a corresponding opposing web ridge, wherein at least one web is of undulating design at least in the area of the web ridge.

21. A method of manufacturing a multi-passageway flat tube, which comprises:

providing an endless, flat sheet metal strip;

punching the through-openings according to a predetermined pattern;

folding the sheet metal strip to form webs, so that one adjacent through-opening meets a corresponding adjacent through-opening;

forming the sheet metal strip containing the webs into a closed multi-passageway flat tube cross section; and brazing the web ridges to the opposing inner wall of the flat tube or to respective opposing web ridges and brazing the longitudinal seam.

22. A method of manufacturing a multi-passageway flat tube, which comprises:

providing an endless, flat sheet metal strip;

folding the sheet metal strip to form the webs;

fashioning notches in the web ridges by stamping or rolling;

forming the sheet metal strip containing the webs into a closed multi-passageway flat tube cross section; and brazing the web ridges to the inner wall of the tube or to corresponding opposing web ridges and brazing the longitudinal seam.

23. A method of manufacturing a multi-passageway flat tube, which comprises:

providing an endless, flat sheet metal strip;

producing the at least one slit according to a predetermined pattern;

folding the sheet metal strip to form the webs, so that one adjacent slit meets another adjacent slit;

forming the at least one edge;

forming the sheet metal strip containing the at least one edge into a closed multi-passageway flat tube cross section; and brazing the web ridges to the opposing inner wall of the tube or to corresponding opposing web ridges and brazing the longitudinal seam.

24. A method of manufacturing a multi-passageway flat tube, which comprises:

providing an endless, flat sheet metal strip;

folding the sheet metal strip to form the webs;

forming the web ridges into an undulating shape;

forming the sheet metal strip containing the undulating shape into a closed multi-passageway flat tube cross section; and brazing the web ridges to the opposing inner wall of the tube or to respective opposing web ridges and brazing the longitudinal seam.

* * * * *